343-756
11/2/76 XR 3,990,080 SR

United States Patent [19]
Lundgren, Jr. et al.

[11] 3,990,080
[45] Nov. 2, 1976

[54] ANTENNA WITH ECHO CANCELLING ELEMENTS

[75] Inventors: Carl William Lundgren, Jr.; George Walter Travis, both of Colts Neck, N.J.

[73] Assignee: Bell Telephone Laboratories, Incorporated, Murray Hill, N.J.

[22] Filed: July 21, 1975

[21] Appl. No.: 597,368

[52] U.S. Cl. ..... 343/782; 343/756; 343/840
[51] Int. Cl.[2] ..... H01Q 19/14
[58] Field of Search ..... 343/781, 782, 783, 840, 343/755, 756, 761, 837, 912

[56] References Cited

UNITED STATES PATENTS

| | | | |
|---|---|---|---|
| 3,133,284 | 5/1964 | Privett et al. | 343/782 |
| 3,148,370 | 9/1964 | Bowman | 343/756 |
| 3,209,361 | 9/1965 | Webb | 343/782 |
| 3,235,870 | 2/1966 | Hannan | 343/782 |
| 3,866,233 | 2/1975 | Schmidt | 343/781 |

*Primary Examiner*—Alfred E. Smith
*Assistant Examiner*—Tommy P. Chin
*Attorney, Agent, or Firm*—Daniel D. Dubosky

[57] ABSTRACT

Improvements are made in a dual frequency echo cancelling assembly for mounting in a hole in the subreflector of a Cassegrainian antenna. Subreflector echo returned to the feed system is cancelled in two frequency ranges by a reflection from the echo cancelling assembly which includes a flat plate, a guard ring surrounding the plate, and a conductive grid between the plate and the feed system. The improvements include wide, thin grid conductors electrically connected to the guard ring and a ring of reflective or absorptive material surrounding the guard ring to cover the subreflector hole edge. When the improved assembly is adjusted for best performance, a stronger reflection in the direction of the feed system is obtained for echo cancelling without sharp resonance peaks. The required diameter for the improved dual frequency echo cancelling assembly is smaller, minimizing blockage of the subreflector and undesirable scattering.

10 Claims, 3 Drawing Figures

ANTENNA WITH ECHO CANCELLING ELEMENTS

BACKGROUND OF THE INVENTION

The present invention relates to antennas for the transmission and reception of microwave energy. More particularly, the present invention relates to an improvement to a microwave antenna for reducing undesirable echo reflections to the feed system, which reflections are superposed, delayed upon the desired transmitted and received microwave energy.

In the field of space communications, a microwave antenna is used to transmit and receive many communications channels. One such antenna is the Cassegrainian antenna, which has a large concave main reflector, a smaller convex subreflector placed forward of the main reflector and a feed system, often located centrally in an opening in the main reflector. Radiation from the feed is reflected from the subreflector to the main reflector and is transmitted from the antenna as a narrow microwave beam.

Unfortunately, some radiation transmitted from the feed is also reflected undesirably back to the feed from the subreflector. This undesirable reflection is called an echo, the echo corresponding with an impedance mismatch, in this case between the feed and subreflector. The echo causes, for example, an objectionable intermodulation background noise component in frequency division multiplexed FM communications channels which sharply increases as the antenna size and number of channels is increased. See Bell Telephone Laboratories, *Transmission Systems for Communications*, 4th Ed., pp. 517–522, 1970.

Heretofore, undesirable echo reflections have been reduced by placing an essentially flat reflecting plate near the subreflector between the subreflector and the feed system to cancel some of the echo at the feed. When the plate reflects radiation to the feed which is equal in amplitude and 180 degrees out of phase at a given frequency with the echo at the feed location from the rest of the subreflector, complete echo cancellation at that frequency is obtained. As the number of communications channels is increased, however, the frequency range over which the sharply increased echo-caused noise can be acceptably cancelled by a flat plate decreases. Furthermore, some communications systems use distinct frequency ranges for simultaneous transmission and reception. Consequently, as the number of channels is increased to take full economic advantage of the antenna, the echo-caused noise in these frequency ranges rises above an acceptable level if a flat plate is employed.

Accordingly, it is an object of the present invention to substantially cancel microwave echo reflections over a wide bandwidth in a microwave antenna.

It is another object of the present invention to substantially eliminate echo-caused channel noise from a Cassegrainian antenna accommodating a large number of communications channels.

It is another object of the present invention to eliminate undesirable echo interference to simultaneously transmitted and received communications channels carried in distinct frequency ranges in a microwave antenna.

Attention is called to the copending application of E. A. Ohm entitled "Antenna with Echo Cancelling Elements," Ser. No. 597,366, filed July 21, 1975, in which there is disclosed a dual frequency echo cancelling structure having a gridded design. According to the disclosure in that application, a frequency sensitive reflecting grid of cylindrical wires is placed parallel to a prior art echo cancelling flat plate located between the feeding means and the subreflector. In this manner, a combined reflection from the grid and the plate suffices to cancel much of the subreflector echo returned to the feed system. It is to be understood that the arrangement disclosed in that copending application is regarded herein as operative for cancellation of echoes in two frequency ranges.

Observations made on such a gridded design, indicate, however, that a more complete echo cancellation may be obtained at more frequencies. Some of the radiation incident upon an echo cancelling grid and plate appears to be scattered in undesired directions and not reflected back to the feed system to assist in echo cancellation. This means that the grid diameter must be larger than would be necessary in the absence of such scattering, and the undesirable results include subreflector blockage, reduction of antenna gain, and increased antenna noise temperature. Furthermore, undesirable stray resonance peaks are observed which when eliminated can improve the echo cancelling properties of that structure.

Therefore, it is a further object of the present invention to accomplish a reduction in size and to reduce stray resonances in a dual frequency echo cancelling structure of the gridded variety.

SUMMARY OF THE INVENTION

In our invention, these and other objects are attained in a microwave antenna having a main reflector, a subreflector, a single small flat plate at the subreflector vertex, and a feed system, such as a Cassegrainian antenna having a single-frequency echo correction. In the transmit and receive modes in distinct frequency ranges, radiation from the feed is successively reflected from a subreflector and a main reflector. Some subreflector echoes, however, return to the feed system incompletely cancelled.

A flat grid having wide, thin conductors instead of cylindrical wires is placed between the flat plate and the feed system. A conducting cylindrical sleeve, or guard ring, herein is electrically connected to the flat grid, suitably in symmetry therewith, as well as to the plate, obviating any need for dielectric supporting material. The assembly may be recessed in a hole in the subreflector. An absorber band or ring or a conical reflecting dispersive band or ring is added around the conducting sleeve. It is found that the amplitude of reflection in the direction of the feed system is increased with this invention, and many stray resonance reflections are eliminated. The echo cancellation by the gridded structure is enhanced by control of amplitudes as well as phases in two frequency ranges, and echo-caused channel noise is reduced. The design permits a radially symmetric absorber or dispersive ring as well as permitting a symmetric placement of the grid. Due to such symmetry, channel distortion arising from undesirable coupling of signals of different polarizations is minimized. The direct metallic connections between the flat grid and guard ring provide thermal paths for deicing the grid and mechanical support for the grid as well. The necessity for design consideration of dielectric supports and their mechanical and electrical life is obviated.

BRIEF DESCRIPTION OF THE DRAWINGS

The invention will be more readily understood by reference to the appended drawings.

DETAILED DESCRIPTION OF THE DRAWINGS

Figure 1:
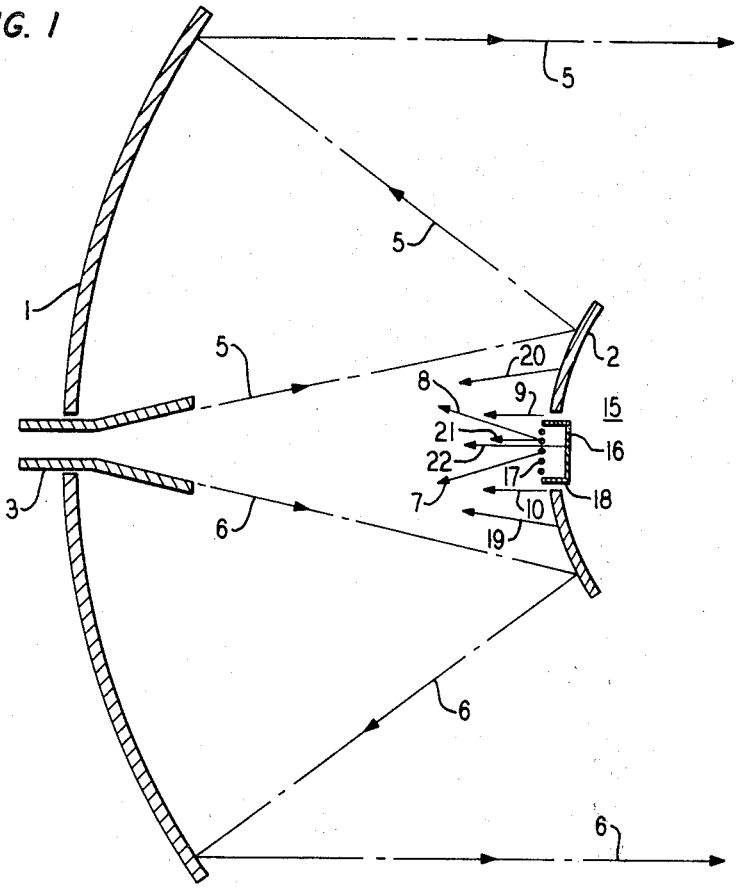
FIG. 1 is a longitudinal cross section of a microwave antenna having a dual frequency echo-cancelling structure.

FIG. 1 shows a longitudinal section of a Casegrainian antenna having a feed horn 3 radiating a beam indicated by rays 5 and 6 which is successively reflected from subreflector 2 and main reflector 1. An undesirable subreflector echo is returned to feed horn 3 as indicated by rays 19 and 20.

This echo is largely cancelled by dual frequency echo-cancelling assembly 15 composed of flat plate 16, cylindrical wire grid 17 suitably supported by radio-transparent dielectric material, and a guard ring 18 connected only to plate 16. Echo-cancelling structure 15 reflects echo-cancelling radiation indicated by the combination of rays 21 and 22.

Unfortunately, echo-cancelling assembly 15 scatters incident radiation as indicated by rays 7 and 8. The scattered radiation is not reflected back to feed horn 3 and propagates in unintended directions. If the radiation indicated by rays 7 nd 8 were returned to the feed horn, the echo cancelling amplitude would be increased and an advantageously smaller would suffice.

Furthermore, resonance reflections occur, including some indicated by rays 9 and 10. The geometry presented to incident radiation by either or both of the outer surface of guard ring 18 and the interior edge of subreflector 2 appears to be responsible for some of the undesirable resonance reflections.

Figure 2:
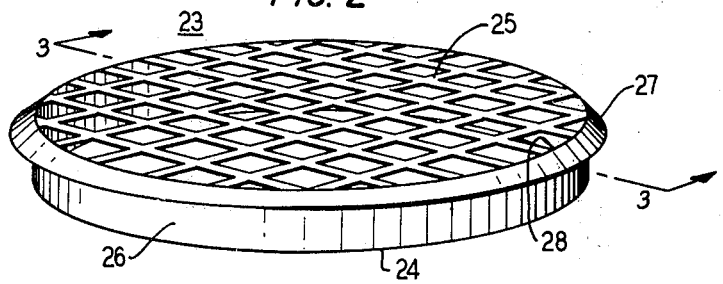
FIG. 2 is a perspective view of an improved gridded echo-cancelling assembly for placement in a microwave antenna according to the present invention.

FIG. 2 shows an improved echo-cancelling assembly 23 which may be used to replace echo-cancelling structure 15 of FIG. 1. Echo-cancelling assembly 23 is a mechanically integral structure having circular flat base plate 24 metallically connected to cylindrical guard ring 26. In turn, the guard ring 26 is electrically connected symmetrically at points such as 28 to a flat grid of wide, thin perpendicular electrical conductors 25. The grid exhibits bilateral symmetry with respect to at least one pair of perpendicular diameters of the plate. This diametric symmetry minimizes cross-polarization distortion, e.g., exchange of energy between horizontal and vertical linear orthogonal polarizations, an important consideration in satellite communications. Guard ring 26 is surrounded by dispersive ring 27 for preventing radiation from reaching the outer guard ring surface and the edge of the subreflector hole and passing therebetween. Ring 27 is suitably a conical lip, or dispersive figure of revolution, which reflects incident radiation. However, ring 27 may also be made of microwave absorber materials familiar to the art.

When mounted in a hole in the subreflector of a microwave antenna, echo-cancelling assembly 23 provides reflections which are more strongly directed back to feed horn 3 due to the wide, thin geometry of the grid conductors 25 and due to their metallic connection to guard ring 26, further restricting misdirected escape of energy from within the gridded structure. At the same time undesirable resonance reflections are decreased by the improvements just mentioned and the ring 27.

Figure 3:
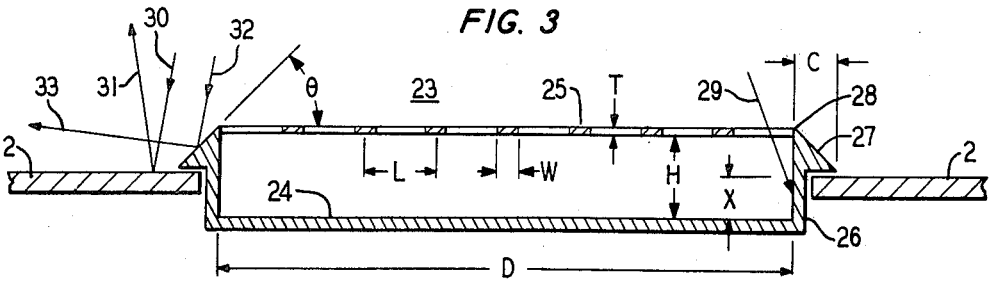
FIG. 3 is a echo-cancelling assembly of FIG. 2 shown mounted in a hole in the subreflector of a microwave antenna according to the present invention.

FIG. 3 is a cross section of FIG. 2 taken along section line 3—3. Assembly 23 is shown mounted in a hole in subreflector 2. The wide, thin conductors of flat grid 25, which intersect at right angles, have a rectangular cross section for which the thickness T is much less than the width W. The thickness T, the width W, and the conductor spacing L are chosen so that grid 25 partially reflects and partially transmits incident microwave energy.

Base plate 24, having diameter D, reflects the energy transmitted through grid 25 so that the combined reflection for grid 24 acts to cancel subreflector echo at the feed location in two frequency ranges. Plate 24 and grid 25 are separated by a distance H. The distance from the reflecting surface of subreflector 2 to the reflecting surface 24 is denoted by X.

Guard ring 26 is electrically and thermally connected to and acts as a mechanical support for plate 24 and grid 25 so that the plate and grid remain parallel. Guard ring 26 also prevents leakage of radiation (see ray 29) transmitted through grid 25.

The conical lip or dispersive cone 27 is a conductive bond surrounding guard ring 27 which hides the outer guard ring surface and the inner edge of subreflector 2 from incident radiation 32. Most of the radiation from feed horn 3, indicated by incident ray 30, is reflected to main reflector 1 by subreflector 2 as indicated by reflected ray 31. That part of the incident radiation indicated by ray 32 which would interact with the guard ring and/or the inner edge of subreflector 2 is deflected by the surface of dispersive cone 27 and leaves as ray 33. The lip angle $\theta$ is chosen such that ray 33 extended does not intercept any other part of the antenna, $\theta = 40°$ being suitable. The lip width C is chosen large enough to cover the inner edge of subreflector 2 and small enough so that a negligible amount of radiation is reflected by the lip away from the antenna.

The dimensions and position of echo-cancelling structure 23 are determined so that the best performance is obtained. The degree of echo cancellation is measured by a technique such as the FM-CW swept frequency type. See, "Introduction to Radar Cross-Section Measurements," by P. Blacksmith et al., *Proceedings of the IEEE*, Volume 53, August 1965, pp. 901–920.

A microwave antenna such as the Cassegrainian antenna of FIG. 1 is initally tested by the use of a flat plate, such as flat plate 16 along. The diameter of that flat plate which provides the proper cancellation amplitude in the lower frequency range is taken as the trial diameter D of the base plate of the dual frequency echo-cancelling structure 23. If the amplitudes of the reflections in both frequency ranges are too large or too small in the dual-frequency structure, the base diameter D is adjusted so that the reflecting area is decreased or increased respectively to provide the correct amplitude.

An iterative experimental procedure such as the one to be described may be used to determine the best grid-to-plate spacing H and plate-to-subreflector spacing X. A grid and plate assembly 23 having selected trial dimensions is mounted adjustably on the subreflector 2. Two distances $X = X_1$ and $X = X_2$ of the plate from the subreflector which yield cancellation nulling at the center of the lower and higher frequency ranges respectively are determined and plotted versus H on a graph. If $X_2 = X_1$, H and X are determined. However, if the high frequency cancellation distance $X_2$ is farther from the subreflector than the low frequency cancellation distance $X_1$, i.e., if $X_2$ exceeds $X_1$, H must be decreased. Conversely, if $X_2$ is less than $X_1$, H must be increased.

When it is necessary to adjust H, the change may be made by an amount $\Delta H = -(X_2 - X_1)$. Then new $X_1$ and $X_2$ are determined by experiment and are plotted versus the new H. If $X_1$ differs from $X_2$ again, another change in H may be calculated from $\Delta H = -(X_2 - X_1)$ or obtained graphically by determining H at the intersection point of the line joining the points for $X_1$ and the line joining the points for $X_2$. The assembly is adjusted and tested by this iterative procedure until one position X suffices for cancellation in both frequency ranges.

Trial values of the dimensions are: grid conductor spacing L equals ¼ wavelength at the center of the lower frequency range; grid-to-plate spacing H equals ¼ wavelength at the center of the lower frequency range; conductor thickness T is ¼ or less of conductor width W; and conductor width W is such that $(W + T/2 = L/10$. Notice that W is about twice as large as the equivalent cylindrical wire diameter. See in this connection, *Waveguide Handbook*, by N. Marcuvitz, MIT Radiation Laboratory Series , Volume 10, Section 5-21, pp. 285–286.

The improved dual-frequency echo cancelling assembly, permits adjustment to be made of the cancelling reflection amplitudes by adjusting dimensions L, W, and/or T and determining by experiment, as above, the required values of H and X. For example, a deliberately smaller dimension for length L would result in a final design and position which reduces the lower frequency cancelling reflection amplitudes relative to those obtained for the higher frequency range. The lower frequency reflection amplitude may also be reduced by increasing the flat grid thickness T, or width W, again requiring different consistent values of H and X in order to obtain the proper relative phases.

The practice of our invention provides control over relative amplitudes, relative phases and resonance reflections in a gridded echo cancelling structure in a microwave antenna. In view of this control over the dual frequency echo cancellation return, more complex structures devised according to the principles of our invention may be envisioned having more than one parallel grid for cancellation in more than two frequency ranges.

The disclosure of the invention hereinabove merely illustrates a few of the many variations which may be employed in practicing our invention. For example, the invention need not be limited to the Cassegrainian antenna. The improved dual-frequency echo cancelling assembly may be modified in numerous ways according to the principles of our invention. In these and other respects, it is to be understood that numerous embodiments are comprehended in the spirit and scope of our invention.

What is claimed is:

1. An antenna comprising a main reflector, a subreflector, and a feed system so arranged that radiation from said feed system is successively reflected from said subreflector and said main reflector, and improved echo cancelling means comprising a reflector recessed behind said subreflector from said feed system, a conducting sleeve metallically connected to said reflector and extending toward said feed system, said subreflector having an inner edge surrounding said sleeve, a grid of thin, wide conductors symmetrically connected to said sleeve electrically, and means for preventing any part of said radiation from passing between said sleeve and said subreflector inner edge.

2. An antenna as claimed in claim 1 wherein said grid conductors have a rectangular cross section having a thickness much less than a width of said cross section.

3. An antenna as claimed in claim 1 wherein said preventing means is a conductive band surrounding said sleeve and having a surface disposed so as to reflect incident radiation away from the rest of the antenna.

4. An antenna as claimed in claim 3 wherein said conductive band is a conical lip.

5. An antenna as claimed in claim 1 wherein said preventing means is an absorber band surrounding said sleeve.

6. An antenna having a main reflector, a subreflector and a feed system in spatial relationship to each other such that radiation from said feed system is reflected from said subreflector and then from said main reflector, a plate mounted near said subreflector in the path of said radiation, and a guard ring surrounding said plate, wherein the improvement comprises a dispersive cone surrounding said guard ring, and a flat grid of wide, thin conductors, metallically connected to said guard ring and mounted parallel to said plate, whereby radiation from said feed system reflected back to said feed system by said subreflector is substantially cancelled by a combined reflection determined by said plate, said grid, said guard ring, and said dispersive cone.

7. An antenna as claimed in claim 6 wherein said grid is connected to said guard ring symmetrically so that cross-polarization distortion is minimized.

8. An antenna as claimed in claim 6 wherein said grid conductors intersect at right angles.

9. An antenna as claimed in claim 6 wherein said subreflector has an interior edge surrounding said guard ring, and said plate is adjustably mounted.

10. An antenna as claimed in claim 6 wherein said main reflector, said subreflector and said feed system form a Cassegrainian antenna.

* * * * *